US010816152B2

(12) United States Patent
Boucher et al.

(10) Patent No.: US 10,816,152 B2
(45) Date of Patent: Oct. 27, 2020

(54) ELECTRONIC LUMINARY WITH MIST FLAME EFFECT

(71) Applicant: Sterno Home Inc., Coquitlam OT (CA)

(72) Inventors: Frederic Boucher, Delson (CA); Carlos Carpintero, Delson (CA); Lucian Hurduc, Ste-Julie (CA)

(73) Assignee: STERNO HOME INC., Coquitlam, British Columbia (CA)

( * ) Notice: Subject to any disclaimer, the term of this patent is extended or adjusted under 35 U.S.C. 154(b) by 85 days.

(21) Appl. No.: 16/173,235

(22) Filed: Oct. 29, 2018

(65) Prior Publication Data

US 2019/0128490 A1 May 2, 2019

Related U.S. Application Data

(60) Provisional application No. 62/578,765, filed on Oct. 30, 2017.

(51) Int. Cl.

| | |
|---|---|
| ***F21S 10/04*** | (2006.01) |
| ***B05B 7/24*** | (2006.01) |
| ***F21S 6/00*** | (2006.01) |
| ***F21W 121/00*** | (2006.01) |
| ***F21S 10/00*** | (2006.01) |

(Continued)

(52) U.S. Cl.

CPC ..... *F21S 10/002* (2013.01); *B05B 7/0012* (2013.01); *B05B 7/2416* (2013.01); *B05B 17/0615* (2013.01); *F21S 6/001* (2013.01); *F21S 10/04* (2013.01); *B05B 1/3415* (2013.01); *B05B 15/40* (2018.02); *F21W 2121/00* (2013.01)

(58) Field of Classification Search

CPC ..... F21S 10/002; F21S 10/04; F21S 6/001

See application file for complete search history.

(56) References Cited

U.S. PATENT DOCUMENTS

| | | | |
|---|---|---|---|
| 9,095,782 | B2 | 8/2015 | Kaplan |
| 9,709,282 | B1 | 7/2017 | Fomenko |

(Continued)

FOREIGN PATENT DOCUMENTS

| | | | |
|---|---|---|---|
| CN | 105179999 | A | 12/2015 |
| CN | 107152663 | A | 9/2017 |

OTHER PUBLICATIONS

Intellectual Property Office, Examination Report under Sections 17 and 18(3) in Application No. GB1817724.6 dated Apr. 8, 2019 (5 pages).

*Primary Examiner* — Leah Simone Macchiarolo

(74) *Attorney, Agent, or Firm* — McAndrews, Held & Malloy, Ltd.

(57) ABSTRACT

A body defines an interior region and an exterior region. A liquid-retaining portion retains a liquid. A mist generator transforms the liquid into a mist. A first chamber receives the mist to form mist-infused fluid. A fan applies pressure to fluid in the second chamber. A first fluid-transferring portion: receives at an inlet the mist-infused fluid from the first chamber in the interior region; emits the mist-infused fluid into the exterior region via an outlet; and changes the velocity of the mist-infused fluid between the inlet and the outlet. A second fluid-transferring portion receives at an inlet the fluid from the second chamber in the interior region and emits this fluid into the exterior region via an outlet. A light source emits light to illuminate the mist-infused fluid in the exterior region.

11 Claims, 8 Drawing Sheets

(51) Int. Cl.

| | |
|---|---|
| ***B05B 7/00*** | (2006.01) |
| ***B05B 17/06*** | (2006.01) |
| *B05B 1/34* | (2006.01) |
| *B05B 15/40* | (2018.01) |

(56) References Cited

U.S. PATENT DOCUMENTS

| | | | | |
|---|---|---|---|---|
| 2008/0036332 | A1* | 2/2008 | Helf | A01M 29/12 310/311 |
| 2015/0300635 | A1 | 10/2015 | Blum | |
| 2016/0305624 | A1* | 10/2016 | Li | A61L 9/03 |
| 2017/0108188 | A1 | 4/2017 | Lai | |
| 2019/0195447 | A1* | 6/2019 | Wu | F21S 10/046 |

* cited by examiner

ELECTRONIC LUMINARY WITH MIST FLAME EFFECT

CROSS REFERENCE TO RELATED APPLICATIONS

This application claims the benefit of U.S. Pat. Appl. No. 62/578,765, filed on Oct. 30, 2017, the entirety of which is herein incorporated by reference.

BACKGROUND

Generally, this application relates to an electric luminary that uses illuminated mist to simulate a conventional flame. While a pillar candle is primarily disclosed herein, the inventive techniques are similarly applicable to other electronic luminary devices, such as other candles (e.g., votive, taper, tea light), lanterns, tiki torches, fireplaces, or the like.

SUMMARY

According to certain inventive techniques, an apparatus includes a body, a fan, a liquid-retaining portion, a mist generator, a first chamber, a second chamber, a first fluid-transferring portion, and a second fluid transferring portion. The body defines an interior region and an exterior region. The liquid-retaining portion retains a liquid. The mist generator transforms the liquid into a mist. The first chamber receives the mist to form mist-infused fluid. The fan applies pressure to fluid in the second chamber. The first fluid-transferring portion: receives at an inlet the mist-infused fluid from the first chamber in the interior region; emits the mist-infused fluid into the exterior region via an outlet; and changes the velocity of the mist-infused fluid between the inlet and the outlet. The second fluid-transferring portion receives at an inlet the fluid from the second chamber in the interior region and emits this fluid into the exterior region via an outlet. The light source emits light to illuminate the mist-infused fluid in the exterior region.

According to certain inventive techniques, the second fluid-transferring portion further may change the velocity of the fluid between the inlet and the outlet of the second fluid-transferring portion. The outlet of the second fluid-transferring portion may substantially surround the outlet of the first fluid-transferring portion. A plurality of vortex-shaping portions may influence a flow pattern of the mist-infused fluid emitted at the outlet of the first fluid-transferring portion and/or the second fluid-transferring portion. A plurality of lamination portions may influence a flow pattern of the mist-infused fluid emitted at the outlet of the first fluid-transferring portion and/or the second fluid-transferring portion.

According to certain inventive techniques, the outlet of the first fluid-transferring portion may include a plurality of apertures. The outlet of the second fluid-transferring portion may include a plurality of apertures. A fluid-flow adjustment portion may adjust the flow of mist-infused fluid through the first fluid-transferring portion. A fluid-flow adjustment portion may adjust the flow of fluid through the second fluid-transferring portion.

According to certain inventive techniques, the light source may be located within the first fluid-transferring portion and/or within the second fluid-transferring portion. The light source may be located below the first fluid-transferring portion. An imitation wick may extend upwardly from an upper surface of the body. The imitation wick may include a light pipe that receives light from the light source in the interior region inside of the body and emits the light in the exterior region outside of the body.

According to certain inventive techniques, an apparatus includes a body, a fan, a liquid-retaining portion, a mist generator, a first chamber, a second chamber, a pathway between the first chamber and the second chamber, a first fluid-transferring portion, and a second fluid transferring portion. The body defines an interior region and an exterior region. The liquid-retaining portion retains a liquid. The mist generator transforms the liquid into a mist. The first chamber receives the mist to form mist-infused fluid. The fan applies pressure to fluid in the second chamber. The pathway permits fluid communication between the first chamber and the second chamber such that the fan applies pressure to the mist-infused fluid in the first chamber. The first fluid-transferring portion: receives at an inlet the mist-infused fluid from the first chamber in the interior region; emits the mist-infused fluid into the exterior region via an outlet; and changes the velocity of the mist-infused fluid between the inlet and the outlet. The second fluid-transferring portion receives at an inlet the fluid from the second chamber in the interior region and emits this fluid into the exterior region via an outlet. The light source emits light to illuminate the mist-infused fluid in the exterior region.

According to certain inventive techniques, the second fluid-transferring portion further may change the velocity of the fluid between the inlet and the outlet of the second fluid-transferring portion. The outlet of the second fluid-transferring portion may substantially surround the outlet of the first fluid-transferring portion. A plurality of vortex-shaping portions may influence a flow pattern of the mist-infused fluid emitted at the outlet of the first fluid-transferring portion and/or the second fluid-transferring portion. A plurality of lamination portions may influence a flow pattern of the mist-infused fluid emitted at the outlet of the first fluid-transferring portion and/or the second fluid-transferring portion. A variable fluid-flow adjustment portion may variably adjust a fluid flow through the pathway.

According to certain inventive techniques, the outlet of the first fluid-transferring portion may include a plurality of apertures. The outlet of the second fluid-transferring portion may include a plurality of apertures. A fluid-flow adjustment portion may adjust the flow of mist-infused fluid through the first fluid-transferring portion. A fluid-flow adjustment portion may adjust the flow of fluid through the second fluid-transferring portion.

According to certain inventive techniques, the light source may be located within the first fluid-transferring portion and/or within the second fluid-transferring portion. The light source may be located below the first fluid-transferring portion. An imitation wick may extend upwardly from an upper surface of the body. The imitation wick may include a light pipe that receives light from the light source in the interior region inside of the body and emits the light in the exterior region outside of the body.

Figure 1:
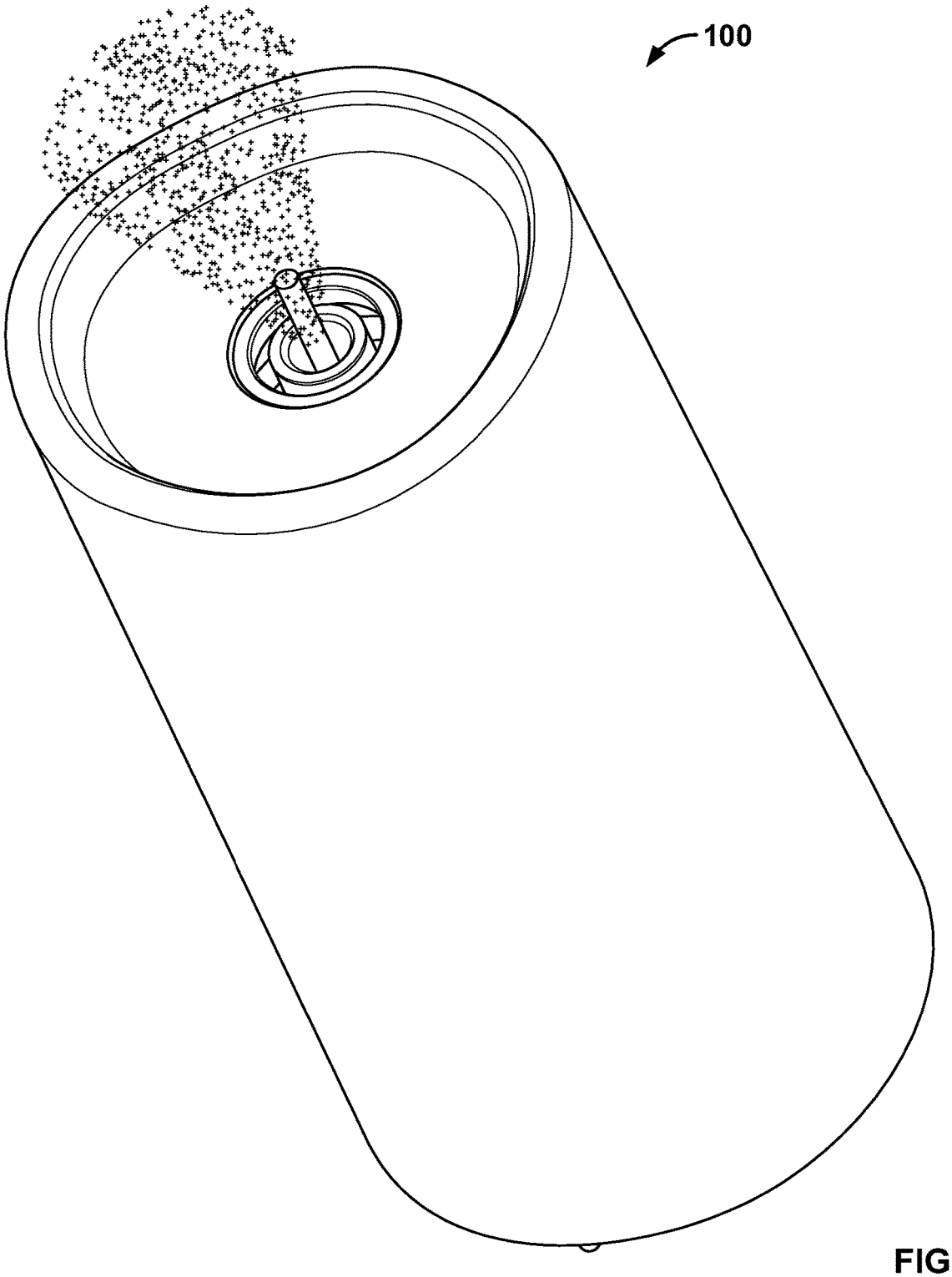
FIG. 1 illustrates a flameless candle, according to certain inventive techniques.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

To simulate a flame of a luminary (for example, a lamp or a candle), a device may include a mist generator (e.g., transducer such as a piezo-electric component), a mixer, first and second chambers, at least one fan, a first fluid-transferring portion (e.g., a nozzle), at least one additional fluid-transferring portion (e.g., another nozzle), and at least one light source. The mist generator may generate a mist (or vapor) from a liquid. The mist may be refined by a mixer to provide an improved density and/or velocity. The mixer may induce a new motion to the mist including, for example, a vortex. The mist may flow and/or be directed through the first chamber to the first fluid-transferring portion. Fan(s) may control independently and force different airflows through the second chamber toward the additional fluid-transferring portion(s). Above the fluid-transferring portions, airflows may create a dynamic envelope surrounding the mist. This envelope may guide the direction, ripple, and/or evaporation of the mist to form a flame shape (or an approximation thereof) made of the mist. At least one light source may be included in the device to illuminate and/or color the mist to generate the illusion of a flame.

FIG. 1 illustrates a flameless candle 100, according to certain inventive techniques. The candle 100 generates mist and emits it through one or more outlets into a region exterior to the candle 100 where it is illuminated. The illuminated mist generates a flame-like effect reminiscent of a conventional combustible candle. The candle 100 is illustrated as a pillar candle, but the inventive principles described herein are equally applicable to other candle shapes or luminary types (e.g., electronic or partially electronic). In particular, the candle 100 may provide two fluid flows to the exterior region as will be further discussed. The first fluid flow may transport a mist-infused fluid, such as mist-infused air. The second fluid flow may transport a fluid substantially without mist, such as just forced air. The second fluid flow may influence the first fluid flow, thereby creating a desirable shape and/or movement for illumination.

Figure 2:
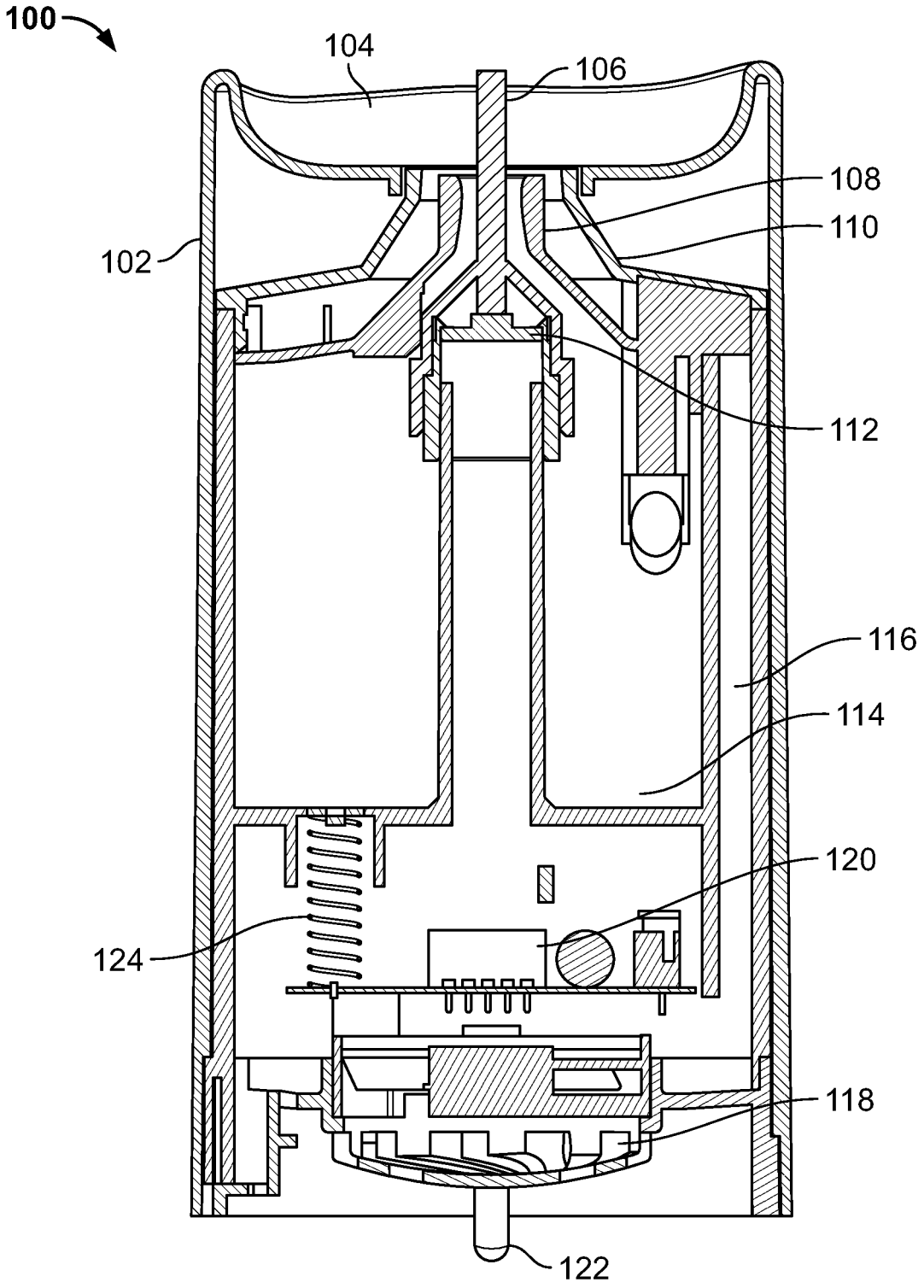
FIG. 2 illustrates a cross-sectional view of a front of a flameless candle, according to certain inventive techniques.
Figure 3:
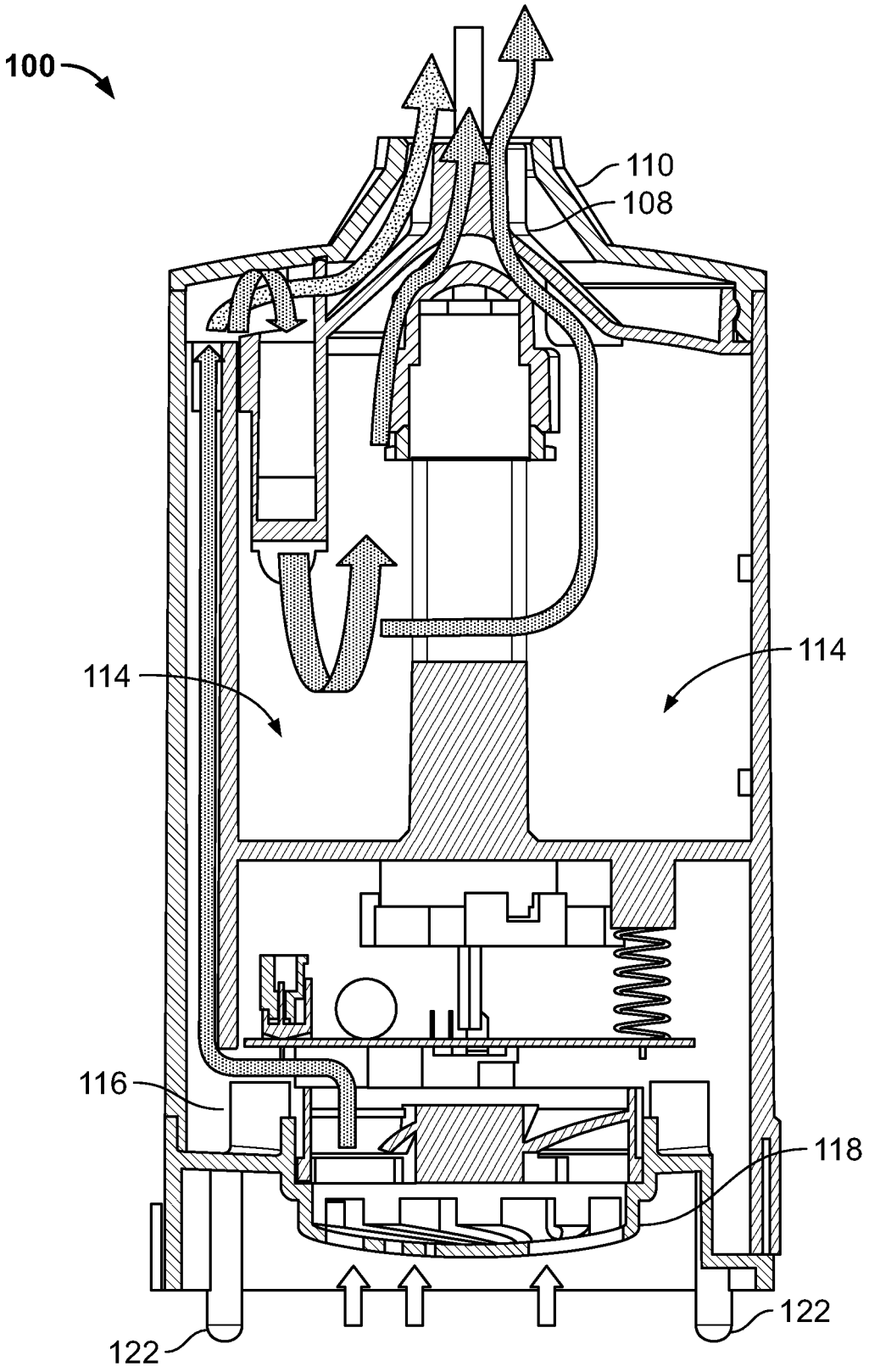
FIG. 3 illustrates a cross sectional view of a side of a flameless candle and representative fluid flow therein, according to certain inventive techniques.

FIG. 2 illustrates a cross-sectional view for a front of a flameless candle 100, according to certain inventive techniques. FIG. 3 illustrates a cross sectional view of a side of the flameless candle 100 and representative fluid flow therein, according to certain inventive techniques. As shown in FIGS. 2 and 3, the body 102 may define an interior region inside of the body 102 and an exterior region outside of the body 102. The candle 100 includes a body 102 including a base. The base of the candle 100 may be offset from a resting surface by one or more risers 122 (e.g., posts, nubs, or the like). The space created by the risers 122 (e.g., 3 risers) and the base may allow for fluid to enter an interior region of the candle 100 from the exterior region of the candle 100 (e.g., through the bottom of the candle 100) as will be further explained.

The candle 100 may include a recess 104 in an upper region of the candle 100. The recess 104 may provide the illusion or be reminiscent of a candle that has been previously used and some wax has been consumed. An upper rim (e.g., a rim with constant or varying height) on the candle body may be formed by the recess 104. The upper rim may be lower in some places than others. For example, the upper rim may have a lower elevation in the "front" of the candle from which a user may more readily view the illuminated mist. The recess 104 at the "rear" of the candle may provide a backdrop (e.g., the rim may be higher in the rear) to improve the flame simulation effect.

Other components of the candle 100 may include a faux wick 106, a first chamber 114, a second chamber 116, a fan 118, a first fluid-transferring portion 108, a second fluid-transferring portion 110, a light source 112, a processor 120, a mist generator 126, and/or a liquid sensor 124.

The first chamber 114 may be in fluid communication with the fan 118. The fan 118 may provide positive pressure and force, for example, a fluid such as air into the first chamber 114. The first chamber 114 may encompass a liquid-retaining portion (e.g., a reservoir), either completely or partially. The liquid-retaining portion may retain a liquid such as water and/or oil. The retained liquid may be scented or unscented or include other components such as insect repellent. According to one technique, the first chamber 114 serves as the liquid-retaining portion. Under this arrangement, the first chamber 114 is understood to encompass the liquid-retaining portion. In other arrangements, the liquid-retaining portion need not be formed in/by the first chamber 114. Instead, as will be further discussed, it is only necessary that the first chamber 114 is in fluid communication with the liquid-retaining portion whereby the first chamber 114 can receive mist from the liquid-retaining portion. Once the mist received from the liquid-retaining portion mixes with the forced air in the first chamber 114, mist-infused fluid may be formed in the first chamber 114.

The liquid-retaining portion may include one or more valves or apertures (either dynamically adjusting, controllable, or static) which may form air inlet(s) to promote pressure and therefore the suitable discharge of liquid from the liquid-retaining portion into a bath (which may also be considered part of the liquid-retaining portion). A bath region may deliver the liquid to the mist generator 126 such that mist is generated when the mist generator 126 is activated.

A lower reservoir valve(s)/aperture(s) may be positioned substantially at the desired top liquid surface of the bath region to maintain an appropriate liquid level in the bath region. When liquid level drops, air may enter by the liquid-retaining portion aperture. By the addition of air in the liquid-retaining portion, liquid from the reservoir may flow into the bath region. When the liquid level goes up, the air may stop entering the liquid-retaining portion and the liquid level is then adjusted. The bath region may include a wall that extends above the desired liquid level to avoid liquid spilling when the flameless candle 100 is tilted.

The liquid-retaining portion may be replaceable. Liquid-retaining portions may be pre-filled with specific liquids containing a suitable amount of chemicals to create, for example, fragrances or insect repellents. Liquid-retaining portions may include a chemical cleaner to reduce organic organism propagation.

The flameless candle 100 may include two liquid-retaining portions: one for water and one for liquid solutions. Each liquid-retaining portion may have its own control to calibrate the dosage found in the bath region. The bath region and the liquid-retaining portion may be arranged as one liquid-retaining portion where all the functions from the bath region and the liquid-retaining portion may be combined.

The level of liquid in the liquid-retaining portion may be monitored by at least one liquid sensor 124 to maintain a level appropriate in order to generate mist and/or not damage the mist generator 126 (discussed below.) The liquid sensor 124 may be used to sense the presence of liquid above it. For example, the liquid sensor 124 may be a capacitive sensor as depicted. According to this technique, in absence of liquid, a capacitance measured or formed by the liquid sensor 124 value may change and trigger the mist generator 126 to stop. For example, the processor 120 may receive information generated at/by the sensor 126 and cause the mist generator 126 to stop once a threshold has been exceeded (either positively or negatively).

A different type of liquid level sensor (not depicted) may be used. Such a sensor may include a float, which may have an electrical conductor and a conductive rail. When the liquid level is in the suitable range, the float may act as an electrical jumper and ground the rail to the liquid. The length of the rail may be equal to the suitable range. As long as the level is in the range, the float may remain in contact with the conductive rail. The electrical contact may be broken when the level of liquid is too high or too low.

The mist generator (e.g., transducer such as a piezoelectric transducer) 126 (for example, as shown in 4B) may be located in the interior region of the candle body 102. The mist generator 126 may generate vibrations that are imparted to the liquid retained in the liquid-retaining portion. The vibrations may cause the liquid to transform into mist (not all the liquid at once, of course, but gradually over time). The mist generator 126 may be a piezoelectric transducer, for example. The mist generator 126 may vibrate or oscillate with a frequency suitable to create a mist from the liquid. Such a frequency may be in the range between 100 kHz and 4 MHz, for example. The frequency may be selected to generate a mist that is suitable for the flame shaping (for example, to promote smooth undulation of the simulated flame). Mist composed of droplets smaller than 5 μm in diameter may be more suitable according to certain techniques.

According to one technique, the mist generator 126 may include a mesh. The mesh may include a membrane with, for example, thousands of holes. The mesh may be used to filter droplets by size. The mist generator 126 may be in direct contact with the liquid in the liquid-retaining portion (for example, fully immersed or only in contact on part of the mist generator 126).

According to one technique, the mist generator 126 may be arranged at an angle (for example, between 2 to 30 degrees from horizontal). This angle may substantially prevent droplets from falling directly above the mist generator 126 and affect mist generation. Relatively heavy droplets may travel relatively shorter distances before they begin to fall. The mist generator 126 angle may alter their initial, upwardly paths so that they fall outside of the mist generator 126 location and thus limit disturbances that may affect mist generation.

The flameless candle 100 may also include a mixer (not shown) that may be arranged so at least a portion of the mixer is positioned within the first chamber 114 (for example, in a lower region of the first chamber 114). The mixer may be used to filter larger size droplets of the mist (for example, droplets having a diameter greater than 5 μm) as the mist travels upwardly. The mixer may also induce a new motion to the mist like, for example, a vortex as it travels upwardly.

The mixer may be assembled or formed integrally with fins that interfere with the upward passage of the mist through the first chamber 114. The fins may have similar, the same, or different aerodynamic shapes. The fin surfaces may have a texture, for example a texture with porosity. The texture may help filtering large droplets by increasing the capillary effect. Relatively large droplets (e.g. greater than 5 μm) may adhere more easily to fin surface with a texture. The fins may include or be made of plastic or any suitable material allowing relatively large droplet retention.

The mixer may include an aperture between the first chamber 114 and at least one additional chamber (e.g., second chamber 116) in order to introduce an additional amount of airflow into the first chamber 116 (and thus, the mist flowing therein) as will be further discussed. The addition of airflow to the mist may change the speed and/or density of the mist. The amount or rate of fluid forced into the first chamber 114 to form the mist-infused fluid may be controlled by changing a speed of the fan 118 or by another adjustment mechanism.

The first chamber 114 may direct or channel the mist-infused fluid to the first fluid-transferring portion 108 (for example, a nozzle). The mist-infused fluid may pass optionally through the mixer. Filtering of relatively larger droplets (e.g., greater than 5 μm) may be facilitated by using a material suitable for providing a capillary effect. An example of such a material is ceramic. The first chamber 114 may include plastic inner surfaces, which may have a texture. The texture may help filtering of large droplets by increasing capillary effect. A mesh texture may be used. The first fluid-transferring portion 108 may include any profile that helps obtaining the appropriate shape of the mist-infused fluid in the exterior region when the mist-infused fluid exits the first fluid-transferring portion 108 through one or more outlets. The first fluid-transferring portion 108 may include plastic and internal surface may include a texture to promote filtering of relatively large droplets. A mesh texture may be suitable. The first chamber 114 and the first fluid-transferring portion 108 may include or be made of plastic or any other suitable material allowing relatively large droplet retention. An example of such a material is ceramic.

Figure 5:
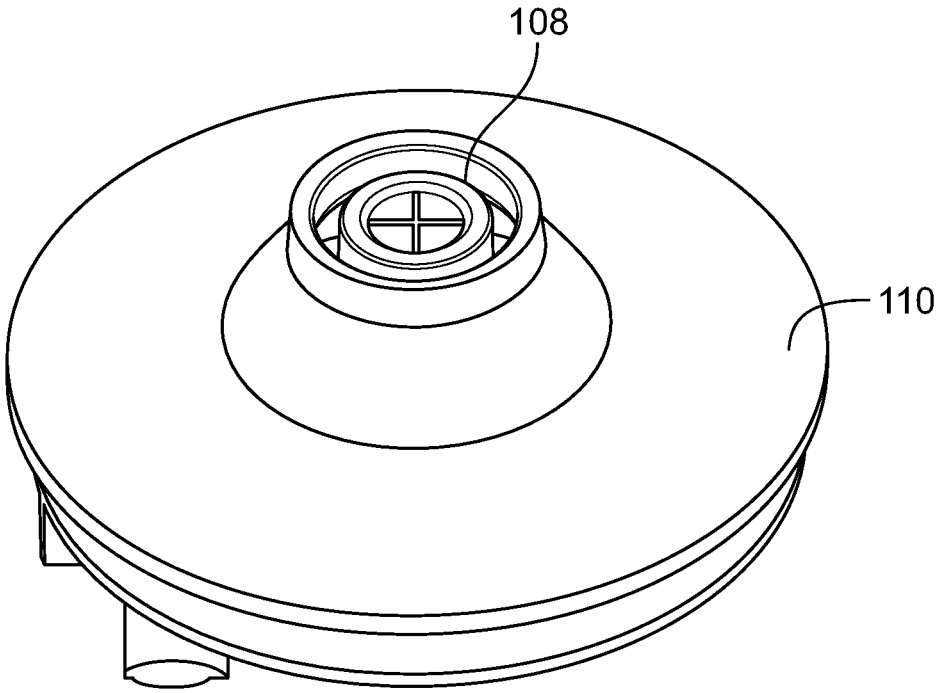
FIG. 5 illustrates a fluid-transferring portion, according to certain inventive techniques.

The first fluid-transferring portion 108 (also depicted in FIGS. 5 and 6) may receive the mist-infused fluid from the first chamber 114 at an inlet of the first fluid-transferring portion 108. The first fluid-transferring portion 108 may emit the received mist-infused fluid into the exterior region of the body 102 at the outlet of the first fluid-transferring portion 108. The first fluid-transferring portion 108 may be shaped such that it can change the velocity of the mist-infused fluid between its inlet and outlet. According to one technique, the first fluid transferring portion 108 may include a porous mesh, and as such has at least one inlet (on the surface facing the first chamber 114) and at least one outlet (on the surface facing away from the first chamber 114 and towards the exterior region of the body 102). As depicted in FIG. 5, the first fluid-transferring portion 108 may include a plurality of outlets, inlets, and/or passageways between the outlet(s) and inlet(s). A fluid-flow adjustment portion may be associated with or included in the first fluid-transferring portion 108. This fluid-flow adjustment portion may adjust a flow of mist-infused fluid through the first fluid-transferring portion 108 (for example, adjust a flow into the inlet of the first fluid-transferring portion 108). This fluid-flow adjustment portion may be manually (for example, through an actuator) or electronically (for example, through the processor 120) controlled.

The candle 100 (for example, the first fluid-transferring portion 108 or the first chamber 114) may include one or more vortex-shaping portions that may influence a flow pattern of the mist-infused fluid emitted at the outlet of the first fluid-transferring portion 108. The vortex-shaping portions may impart a vortex motion to the mist-infused fluid such that a vortex is shaped when the mist-infused fluid is emitted into the exterior region. The candle 100 (for example, the first fluid-transferring portion 108 or the first chamber 114) may include one or more lamination portions that may influence a flow pattern of the mist-infused fluid emitted at the outlet of the first fluid-transferring portion 108. The lamination portions may impart a laminar flow to the mist-infused fluid such that a substantially laminar flow of the mist-infused fluid is emitted into the exterior region.

The second chamber 116 may be arranged in the interior region of the body 102. The second chamber 116 may be in fluid communication with the fan 118, such that pressure is applied to the fluid in the second chamber, and the fluid is forced through the second chamber 116 and to the second fluid-transferring portion 110. The second chamber 116 may be more proximate to the inner wall of the body 102 than the first chamber 114. According to one technique, the second chamber 116 surrounds or at least partially surrounds the first chamber 114.

The second chamber 116 may be in fluid communication with the first chamber 114 through one or more pathways (collectively, a pathway), or may be isolated therefrom. When there is fluid communication between the first chamber 114 and the second chamber 116, fluid may be forced by the fan 118, through the second chamber 116, and at least partially into the first chamber 114 through the pathway. While some fluid may be diverted from the second chamber 116 to the first chamber 114 when there is fluid communication between the chambers, a remainder of fluid flowing through the second chamber 116 may be delivered to the second fluid-transferring portion 110.

A variable fluid-flow adjustment portion may adjust the amount of fluid flow from the second chamber 116 into the first chamber 114. The variable fluid-flow adjustment portion may include a valve or other adjustable mechanism that is capable of varying the amount of fluid that flows between the chambers 114, 116. The fluid-flow adjustment portion may be manually adjustable (for example, by an actuator) or electronically adjustable (for example, by processor 120). According to certain techniques, if the fan 118 has variable speeds, the fan 118 may be considered to be a type of variable fluid-flow adjustment portion. For example, a variable speed fan 118 may adjust a fluid flow through the pathway between the chambers 114, 116.

Figure 6:
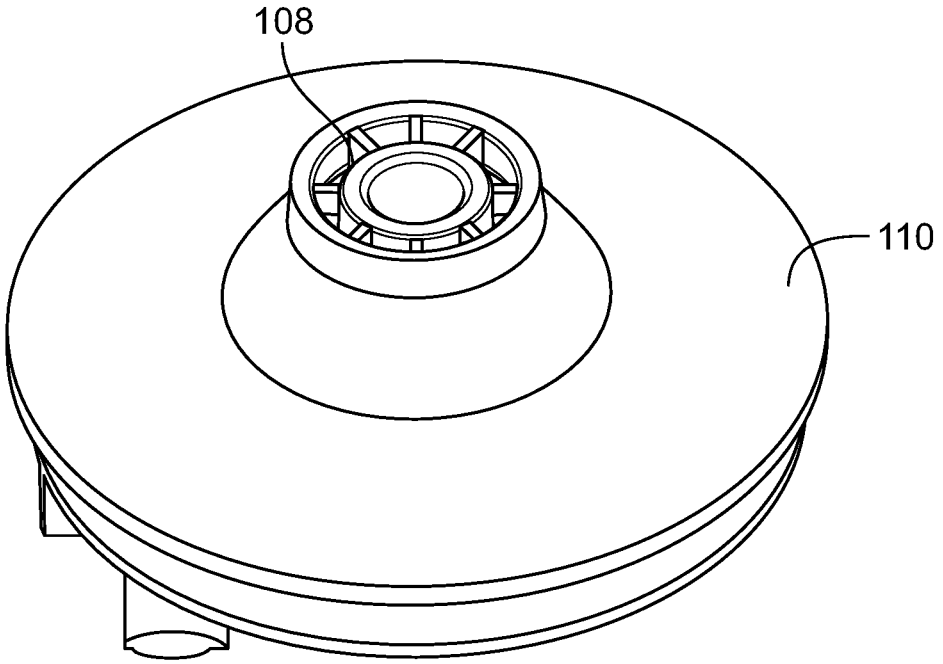
FIG. 6 illustrates a fluid-transferring portion, according to certain inventive techniques.

The second fluid-transferring portion 110 (also depicted in FIGS. 5 and 6) may receive the fluid from the second chamber 116 at an inlet of the second fluid-transferring portion 110. The second fluid-transferring portion 110 may emit the received fluid into the exterior region of the body 102 at the outlet of the second fluid-transferring portion 110. The second fluid-transferring portion 110 may be shaped such that it can change the velocity of the mist-infused fluid between its inlet and outlet. According to one technique, the second fluid transferring portion 110 may include a porous mesh, and as such has at least one inlet (on the surface facing the second chamber 116) and at least one outlet (on the surface facing away from the second chamber 116 and towards the exterior region of the body 102). As depicted in FIG. 6, the second fluid-transferring portion 110 may include a plurality of outlets, inlets, and/or passageways between the outlet(s) and inlet(s).

For the second fluid-transferring portion 110, the inlet, outlet, and/or passageway(s) in between may be formed in conjunction with the first fluid-transferring portion 108. For example, as depicted, the second fluid-transferring portion 110 substantially surrounds the first fluid-transferring portion 108. According to this technique, the inlet to the second fluid-transferring portion 110 is formed between the second fluid-transferring portion 110 and the first fluid-transferring portion 108. The same may be the case for the outlet of the second fluid-transferring portion 110 and/or the passageway(s) between the inlet and outlet. A fluid-flow adjustment portion may be associated with or included in the second fluid-transferring portion 110. This fluid-flow adjustment portion may adjust a flow of fluid through the second fluid-transferring portion 110 (for example, adjust a flow into the inlet of the second fluid-transferring portion 110). This fluid-flow adjustment portion may be manually (for example, through an actuator) or electronically (for example, through the processor 120) controlled.

The candle 100 (for example, the second fluid-transferring portion 110 or the second chamber 116) may include one or more vortex-shaping portions that may influence a flow pattern of the fluid emitted at the outlet of the second fluid-transferring portion 110. The vortex-shaping portions may impart a vortex motion to the fluid such that a vortex is shaped when the fluid is emitted into the exterior region. The candle 100 (for example, the second fluid-transferring portion 110 or the second chamber 116) may include one or more lamination portions that may influence a flow pattern of the fluid emitted at the outlet of the second fluid-transferring portion 110. The lamination portions may impart a laminar flow to the fluid such that a substantially laminar flow of the fluid is emitted into the exterior region.

The light source 112 may illuminate and/or color the mist-infused fluid in the exterior region. A light source 112 may include one or more individual sources that can collectively be understood to be a light source 112. The light source 112 may include LEDs or any other suitable types of light source. The light source 112 may have a fixed intensity or generate patterns of variable intensities and/or variable colors like for example flickers (to simulate a natural flame) and/or color changing effects. The light source 112 may be positioned in an upper region of the candle 100 to illuminate the mist-infused fluid in the exterior region directly. The light source 112 may be positioned elsewhere on the candle 100 and illuminate the mist-infused fluid in the exterior region through, for example, light guides or light pipes (for example, optical fibers or acrylic materials). One such light guide or light pipe may be the faux wick 106 discussed below. The light source 112 may be positioned inside the mist-infused fluid trajectory lighting upward. The light source 112 may be positioned underneath the mist-infused fluid in the exterior region and/or directed to emit light upwardly towards the mist-infused fluid in the exterior region. For example, the light source 112 may be located below the first fluid-transferring portion 108 and direct light up through the outlet of the first fluid-transferring portion 108. The light source 112 may also be positioned to project light from outside of the mist-infused fluid in the exterior region towards the mist-infused fluid in the exterior region. For example, two or more individual sources in the light source 112 may project light from outside of the mist-infused fluid in the exterior region to illuminate the mist-infused fluid on more than one side. The light source 112 may be located in the first fluid-transferring portion 108 and/or the second fluid-transferring portion 110.

The faux wick 106 may include a suitable material that gives it a natural look. The faux wick 106 may include a light guide or light pipe. The faux wick 106 may include material(s) suitable for a light guide/pipe, such as plastic, acrylic, or optical fiber. The faux wick 106 may guide/pipe the light emitted from the light source 112 to another location, such as inside the mist. The light carried by the light guide/pipe may be used to create special effects like for example a hot spot at the end of the faux wick 106 or a blue hue surrounding the faux wick 106. One technique for creating a hot spot is to cover a portion of the faux wick 106 with a substantially opaque material (e.g., a sheath or paint) except for a portion of the upper region of the faux wick 106. The faux wick 106 may receive light in the interior region inside the body 102 and emit the light in the exterior region outside the body 102.

The fan 118 may crate positive pressure in the second chamber 116 and/or first chamber 114, thereby forcing fluid (e.g., air) through the chamber(s). According to one technique, more than one fan may be employed. For example, one fan may be used to force fluid through the first chamber 114 while a second fan is used to force air through the second chamber 116. The fan 118 may be a constant speed or variable speed fan. Air may be drawn into the candle 100 via aperture(s) in the bottom or side of the candle 100.

The liquid sensor 124 may be based on capacitive coupling that detects the near presence of liquid. The detection may be detected by the processor 120. If there is no liquid detected, the processor 120 may cause the mist generator 126 to stop operating.

The processor 120 may control operations of the candle 100. The processor 120 and other electronic circuitry (e.g., light source 112 and fan 118) may receive power via a source external to the candle 100 or from batter(ies) located in the candle 120. The candle 100 may also include one or more memories that store data and executable instructions to operate the processor 120. The processor 120 may receive inputs from a user interface (located on the candle 100, e.g., the bottom of the candle, or remotely and communicating through a wireless link such as infrared, light, radio waves, microwaves, etc.). The user interface may be electromechanical (switches, push-buttons, capacitive inputs, etc.) and/or electrical (displays, such as LEDs, etc.). The processor 120 may control the light source 112 in the manner described herein. The processor 120 may control the fan 118 in the manner described herein. The processor 120 may control the mist generator 126 in the manner described herein. The processor 120 may evaluate a status of sensor 124 to determine if there is sufficient liquid in the liquid-retaining portion and/or bath. If there is insufficient liquid detected, then the processor 120 may turn off the light source 112, the fan 118, and the mist generator 126. The processor 120 may cause the light source 112 to vary (e.g., flicker, fade, etc.) and/or change colors.

Figure 4A:
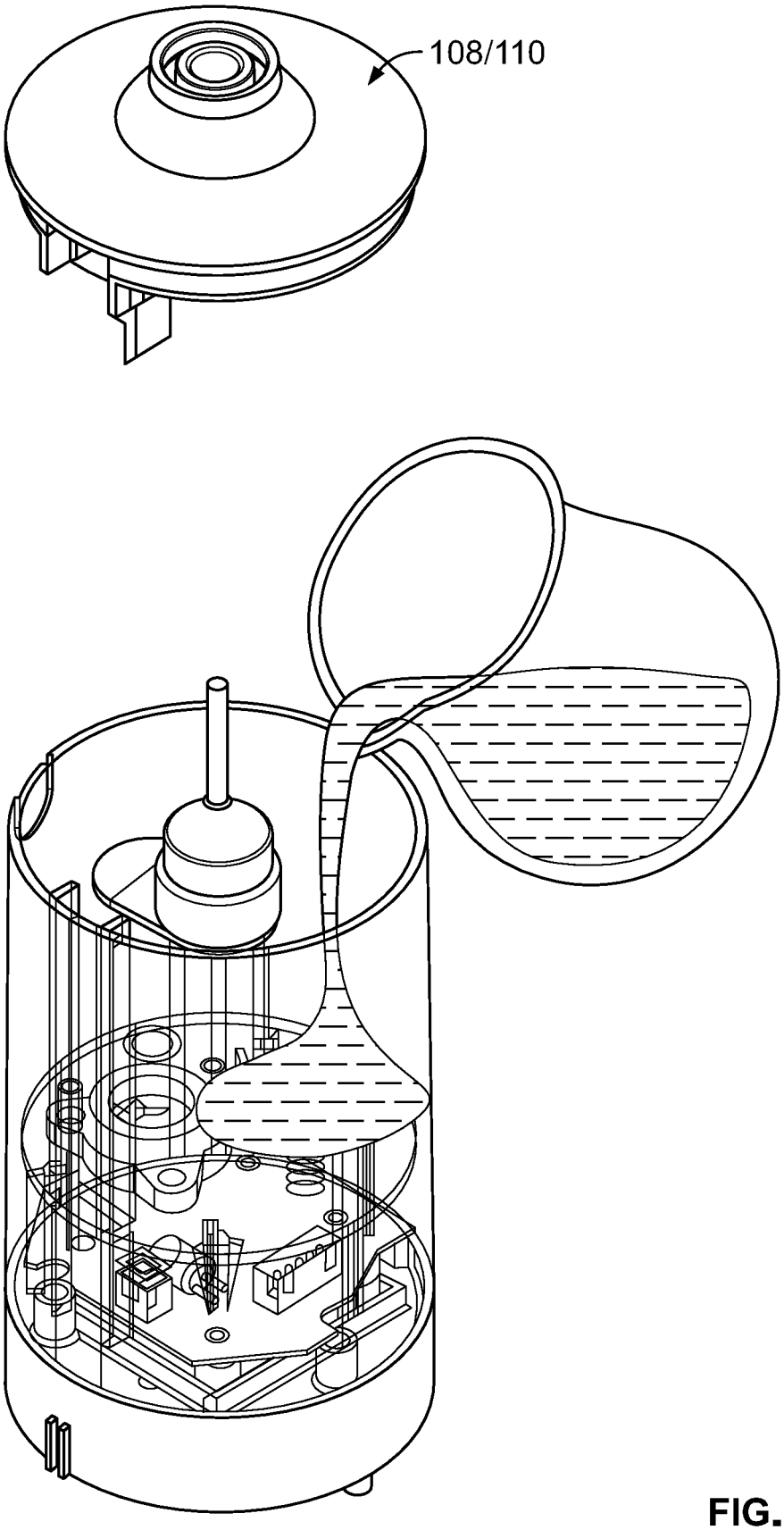
FIGS. 4A, 4B, and 4C illustrate techniques for filling a reservoir with a liquid and generating mist in a flameless candle, according to certain inventive techniques.
Figure 4B:
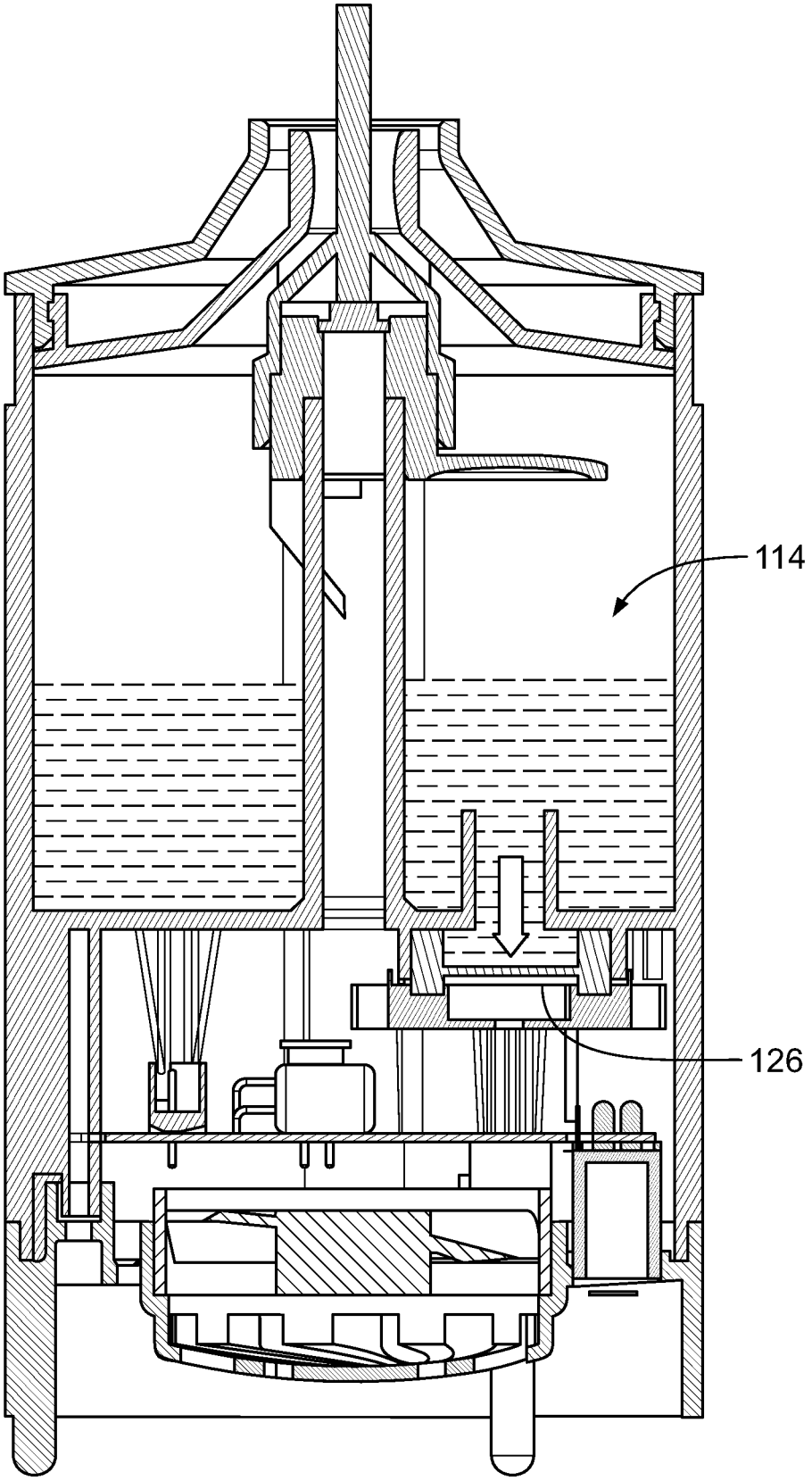
Figure 4C:
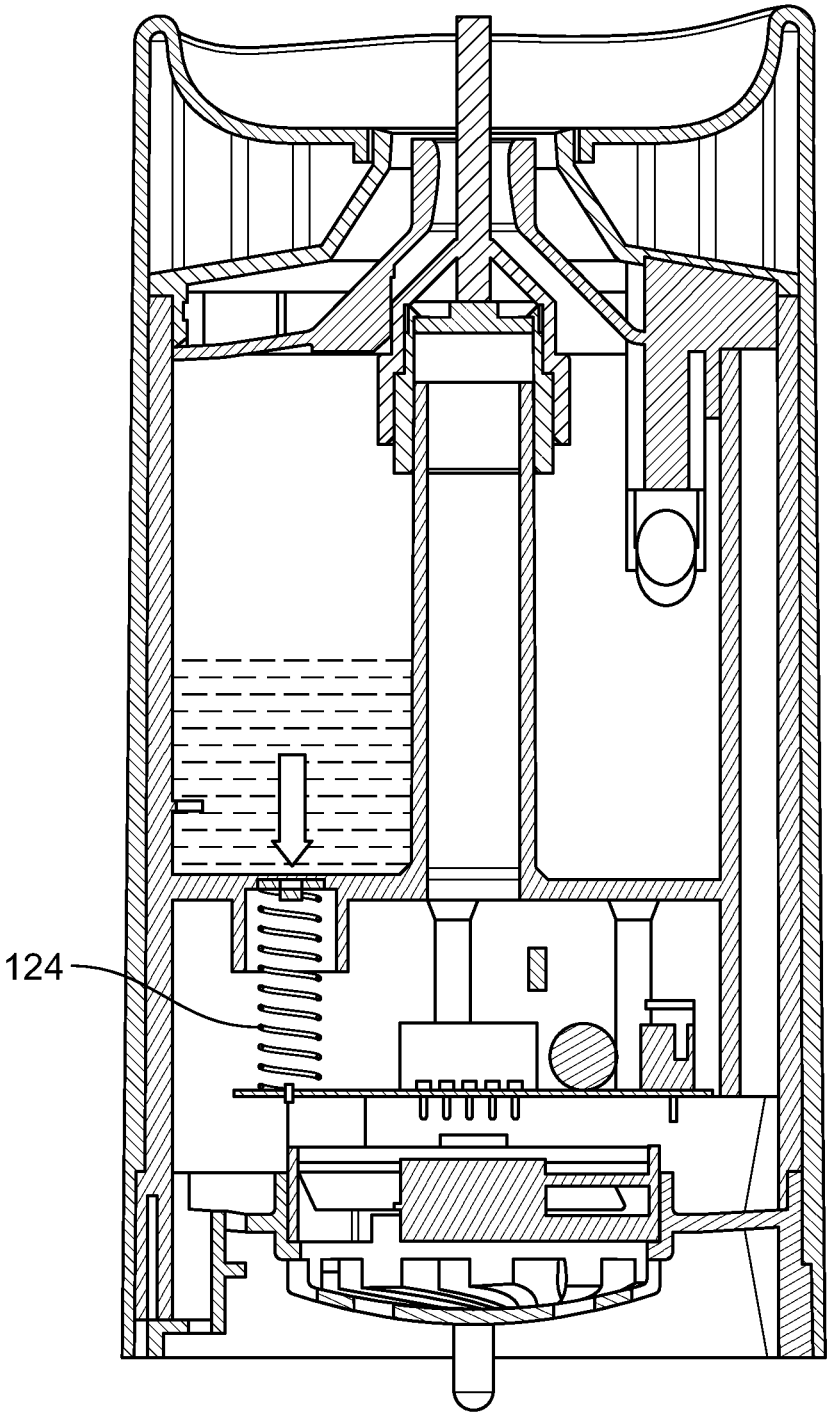

FIG. 4A depicts the process of adding liquid to the liquid-retaining portion. The first fluid-transferring portion 108 and the second fluid-transferring portion 110 may be connected or integrally formed as one assembly. These portions 108, 110 may be lifted off of the candle 100. Then a user has access to the fluid-retaining portion (e.g., access to the first chamber 114). Liquid may then be added into the liquid-retaining portion. FIG. 4B depicts a cross-sectional view of the candle 100 illustrating the liquid-retaining portion and bath where the liquid is exposed or sufficiently coupled to the mist generator 126 to form mist. FIG. 4C depicts the sensor 114 detecting the presence of liquid in the liquid-retaining portion.

A music source may be included in the candle 100 and, optionally, provide inputs to the light source 112 and/or mist generating components (for example, fan 118 or mist generator 126). The music source may be a wireless streaming or recorded music stored, for example, in memory (for example, non-volatile memory). The music may be transferred to a speaker (for example, inside or on the surface of the luminary) or simply used to create effects on the mist diffusion. The candle 100 may include a microphone to capture sound which can be used in a similar fashion as the music source.

For illustrative purposes, the candle 100 may operate in the following manner. A user may turn the candle 100 ON via the user interface such that the signal is delivered to the processor 120. The processor 120 may subsequently activate the mist generator 126, the light source 112, and the fan 118. Liquid in the liquid-retaining portion may flow into a bath region where it is exposed to the mist generator 126. The mist generator 126 may cause mist to be generated, thereby forming mist-infused fluid in the first chamber 114. The fan 118 may draw fluid into the candle 100 via a space below the body 102 created by the risers 122 and apertures in the base of the body 102. The fan 118 may force the fluid through the second chamber 116. Part of this fluid flow may travel through a pathway into the first chamber 114, while another part of the fluid flow may travel to the inlet of the second fluid-transferring portion 110. As the fluid flows through the second fluid-transferring portion 110, the velocity of the flow changes before it is emitted at the outlet of the second fluid-transferring portion 110. The velocity may increase or decrease according to the design of the second fluid-transferring portion 110. Mist-infused fluid may be forced from the first chamber 114 to the inlet of the first fluid-transferring portion 108. The mist-infused fluid may travel through a passageway to the outlet of the first fluid-transferring portion 108. As the mist-infused fluid flows through the first fluid-transferring portion 108, the velocity of the flow changes before it is emitted at the outlet of the first fluid-transferring portion 108. The velocity may increase or decrease according to the design of the first fluid-transferring portion 108. Light is emitted from light source 112 (located in the interior region of the body 102) to the faux wick 106. The faux wick 106 pipes the light where it is transmitted into the exterior region of the body 102 (where the mist-infused fluid has been emitted). The user turns the candle 100 OFF via the user interface and the processor 120 receives this signal. The processor 120 then causes the candle 100 to power down, causing the fan 118, the light source 122, and the mist generator 126 to turn OFF.

Figure 7A:
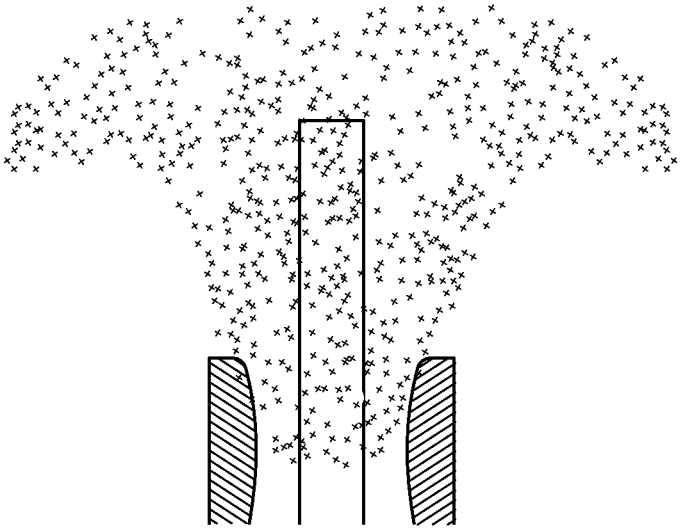
FIG. 7A illustrates a mist-infused fluid flow being emitted from a flameless candle.
Figure 7B:
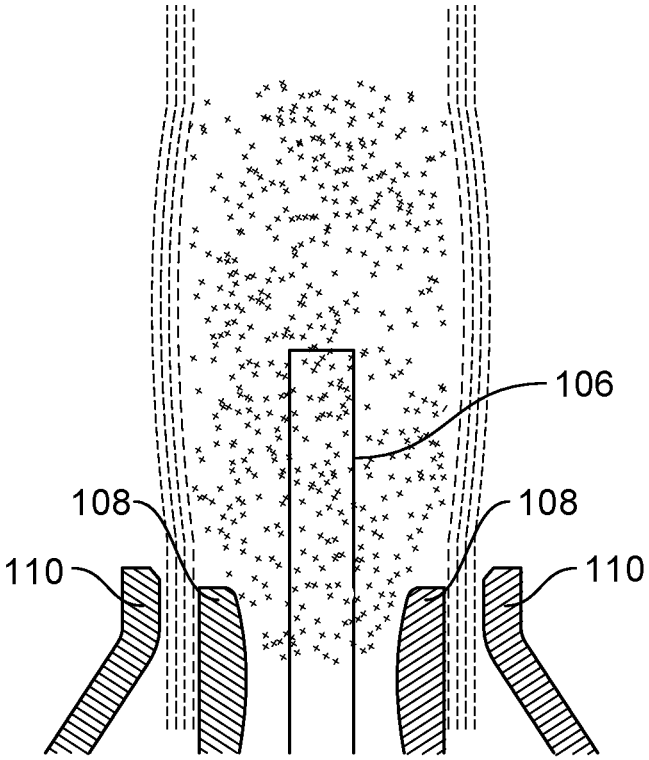
FIG. 7B illustrates a mist-infused fluid flow enveloped by another fluid flow being emitted from a flameless candle, according to certain inventive techniques.

FIG. 7A illustrates a mist-infused fluid flow being emitted from a flameless candle. FIG. 7B illustrates a mist-infused fluid flow enveloped by another fluid flow being emitted from flameless candle 100, according to certain inventive techniques.

The fluid emitted from the second fluid-transferring portion 110 may induce a pressure on the mist-infused fluid emitted from the first fluid-transferring portion 108, thereby increasing the height where the mist-infused fluid starts falling down. Furthermore, the fluid emitted from the second fluid-transferring portion 110 may increase the evaporation rate of the mist further reducing the amount of mist-infused fluid that falls down. These flows and the interactions therebetween may be influenced by creating vortices and/or laminar flows in the two flows to achieve desired results.

According to one technique, the fluid flow emitted from the second fluid-transferring portion 110 may completely or substantially circumscribe the mist-infused fluid flow emitted from the first fluid-transferring portion 108. By having a second flow, for example an outer flow circumscribing the mist-infused fluid flow, it may be possible to reduce the speed at which the mist-infused fluid flow travels, thereby allowing the height of the mist-infused fluid in the exterior region to promote an effective illusion of a flame. For example, without the second flow, the mist-infused fluid flow may need to be relatively fast, thereby leading to a misted region that is too high (e.g., higher than a typical candle flame).

According to one technique, the mist-infused fluid flow in the exterior region is substantially laminar. The faux wick 106, for example, may promote such a laminar flow. The second flow may or may not be laminar. According to one technique, the second fluid flow may have a velocity that is greater than the mist-infused fluid flow.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. An apparatus comprising:
- a body defining an interior region inside of the body and an exterior region outside of the body;
- a fan;
- a liquid-retaining portion configured to retain a liquid;
- a mist generator configured to transform the liquid into mist;
- a first chamber configured to receive the mist to form mist-infused fluid;
- a second chamber, wherein the fan applies pressure to fluid in the second chamber;
- a first fluid-transferring portion including an inlet and an outlet, wherein the first fluid-transferring portion is configured to:
  - receive the mist-infused fluid from the first chamber at the inlet of the first fluid-transferring portion in the interior region;
  - emit the received mist-infused fluid into the exterior region at the outlet of the first fluid-transferring portion; and
  - change a velocity of the mist-infused fluid between the inlet and the outlet of the first fluid-transferring portion;
- a second fluid-transferring portion including an inlet and an outlet, wherein the outlet of the second fluid-transferring portion substantially surrounds the outlet of the first fluid-transferring portion, wherein the second fluid-transferring portion is configured to:
  - receive fluid from the second chamber at the inlet of the second fluid-transferring portion in the interior region; and
  - emit the received fluid into the exterior region at the outlet of the second fluid-transferring portion; and
- a light source configured to emit light to illuminate the mist-infused fluid in the exterior region.

2. The apparatus of claim 1, wherein the second fluid-transferring portion is further configured to change a velocity of the fluid between the inlet and the outlet of the second fluid-transferring portion.

3. The apparatus of claim 1, wherein the light source is located below the first fluid-transferring portion.

4. The apparatus of claim 1, further comprising an imitation wick extending upwardly from an upper surface of the body.

5. The apparatus of claim 4, wherein the imitation wick comprises a light pipe configured to receive light from the light source in the interior region inside of the body and emit the light in the exterior region outside of the body.

6. An apparatus comprising:
- a body defining an interior region inside of the body and an exterior region outside of the body;
- a fan;
- a liquid-retaining portion configured to retain a liquid;
- a mist generator configured to transform the liquid into mist;
- a first chamber configured to receive the mist to form mist-infused fluid;
- a second chamber, wherein the fan applies pressure to fluid in the second chamber;
- a pathway configured to permit fluid communication between the first chamber and the second chamber such that the fan applies pressure to the mist-infused fluid in the first chamber;
- a first fluid-transferring portion including an inlet and an outlet, wherein the first fluid-transferring portion is configured to:
  - receive the mist-infused fluid from the first chamber at the inlet of the first fluid-transferring portion in the interior region;
  - emit the received mist-infused fluid into the exterior region at the outlet of the first fluid-transferring portion; and
  - change a velocity of the mist-infused fluid between the inlet and the outlet of the first fluid-transferring portion;
- a second fluid-transferring portion including an inlet and an outlet, wherein the outlet of the second fluid-transferring portion substantially surrounds the outlet of the first fluid-transferring portion, wherein the second fluid-transferring portion is configured to:
  - receive fluid from the second chamber at the inlet of the second fluid-transferring portion in the interior region; and
  - emit the received fluid into the exterior region at the outlet of the second fluid-transferring portion; and
- a light source configured to emit light to illuminate the mist-infused fluid in the exterior region.

7. The apparatus of claim 6, wherein the second fluid-transferring portion is further configured to change a velocity of the fluid between the inlet and the outlet of the second fluid-transferring portion.

8. The apparatus of claim 6, further comprising a variable fluid-flow adjustment portion configured to variably adjust a fluid flow through the pathway.

9. The apparatus of claim 6, wherein the light source is located below the first fluid-transferring portion.

10. The apparatus of claim 6, further comprising an imitation wick extending upwardly from an upper surface of the body.

11. The apparatus of claim 10, wherein the imitation wick comprises a light pipe configured to receive light from the light source in the interior region inside of the body and emit the light in the exterior region outside of the body.

* * * * *